US010696519B2

(12) United States Patent
Bruno

(10) Patent No.: US 10,696,519 B2
(45) Date of Patent: Jun. 30, 2020

(54) AUTOMATIC TEST OF DETERRENT DEVICE

(71) Applicant: OTIS ELEVATOR COMPANY, Farmington, CT (US)

(72) Inventor: Gilles Bruno, Chateauneuf sur Loire (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 375 days.

(21) Appl. No.: 15/799,565

(22) Filed: Oct. 31, 2017

(65) Prior Publication Data

US 2018/0118514 A1 May 3, 2018

(30) Foreign Application Priority Data

Oct. 31, 2016 (EP) ..... 16290209

(51) Int. Cl.

| | |
|---|---|
| ***B66B 5/00*** | (2006.01) |
| ***B66B 1/34*** | (2006.01) |
| ***B66B 5/02*** | (2006.01) |
| ***B66B 9/00*** | (2006.01) |
| ***B66B 13/12*** | (2006.01) |

(52) U.S. Cl.

CPC ..... *B66B 5/0093* (2013.01); *B66B 1/3461* (2013.01); *B66B 5/0012* (2013.01); *B66B 5/0037* (2013.01); *B66B 5/02* (2013.01); *B66B 9/00* (2013.01); *B66B 13/12* (2013.01)

(58) Field of Classification Search

CPC ... B66B 5/0093; B66B 1/3461; B66B 5/0012; B66B 5/02; B66B 9/00; B66B 13/12

USPC ..... 187/247

See application file for complete search history.

(56) References Cited

U.S. PATENT DOCUMENTS 4,342,378 A * 8/1982 Hmelovsky ..... G05B 19/416 187/316
4,342,379 A * 8/1982 Games ..... G05B 19/416 187/316
4,999,551 A * 3/1991 Yoshida ..... B66B 13/143 318/286
5,027,299 A 6/1991 Uetani (Continued)

FOREIGN PATENT DOCUMENTS

CN 101269771 A 9/2008
CN 102070054 A 5/2011

(Continued)

OTHER PUBLICATIONS

European Search Report for Application No. 16290209.2-1731 dated Apr. 12, 2017 (8 pp).

(Continued)

*Primary Examiner* — David S Warren

(74) *Attorney, Agent, or Firm* — Cantor Colburn LLP

(57) ABSTRACT

A method and system for testing an elevator car door interlock and deterrent mechanism in an elevator system is disclosed. The method includes the steps of: ensuring that no passengers are in the elevator car and closing the elevator car door; operating the elevator car to move it away from the selected landing; commanding the elevator car door to open for a predetermined duration and measuring the displacement of the elevator car door from a closed position; and closing the elevator car door and operating the elevator car to return to a landing.

14 Claims, 6 Drawing Sheets

(56) References Cited

U.S. PATENT DOCUMENTS

| | | | | | |
|---|---|---|---|---|---|
| 5,274,312 | A * | 12/1993 | Gerstenkorn | E05F 1/025 318/617 | |
| 5,587,565 | A * | 12/1996 | Schroder-Brumloop | G05B 19/416 187/316 | |
| 5,711,112 | A * | 1/1998 | Barten | B66B 13/08 49/118 | |
| 5,785,153 | A * | 7/1998 | Powell | B66B 1/18 187/249 | |
| 5,864,104 | A * | 1/1999 | Tawada | B66B 13/146 187/316 | |
| 6,471,014 | B1 | 10/2002 | Daniel et al. | | |
| 6,863,161 | B2 | 3/2005 | Mearns et al. | | |
| 7,073,633 | B2 | 7/2006 | Weinberger et al. | | |
| 7,318,500 | B2 | 1/2008 | Rekinen et al. | | |
| 7,448,473 | B2 | 11/2008 | Lindberg et al. | | |
| 8,069,958 | B2 | 12/2011 | Lence-Barreiro | | |
| 8,540,057 | B2 | 9/2013 | Schuster et al. | | |
| 9,061,864 | B2 | 6/2015 | Spirgi et al. | | |
| 2003/0000777 | A1* | 1/2003 | Lence Barreiro | B66B 13/22 187/391 | |
| 2005/0082121 | A1 | 4/2005 | Deplazes | | |
| 2014/0262629 | A1 | 9/2014 | Toutaoui | | |
| 2014/0353090 | A1* | 12/2014 | Muller | B66B 1/3492 187/393 | |
| 2015/0293799 | A1 | 10/2015 | Sekine et al. | | |
| 2017/0029246 | A1* | 2/2017 | Kulak | B66B 13/24 | |
| 2017/0315262 | A1* | 11/2017 | Collins | E05F 15/74 | |
| 2018/0079620 | A1* | 3/2018 | Schroeder-Brumloop | B66B 5/0031 | |
| 2018/0086605 | A1* | 3/2018 | Saarela | B66B 5/0031 | |
| 2018/0118514 | A1* | 5/2018 | Bruno | B66B 5/0093 | |
| 2019/0330017 | A1* | 10/2019 | Kattainen | B66B 1/3446 | |
| 2019/0352134 | A1* | 11/2019 | Tscuppert | B66B 5/0025 | |

FOREIGN PATENT DOCUMENTS

| | | | | |
|---|---|---|---|---|
| CN | 202201591 | U | 4/2012 | |
| CN | 103231963 | U | 8/2013 | |
| CN | 203545412 | U | 4/2014 | |
| CN | 103827012 | A | 5/2014 | |
| CN | 103910260 | A | 7/2014 | |
| CN | 104310135 | A | 1/2015 | |
| CN | 104512773 | A | 4/2015 | |
| CN | 104876074 | A | 9/2015 | |
| CN | 103879846 | B | 1/2016 | |
| CN | 105236251 | A | 1/2016 | |
| CN | 205170092 | U | 4/2016 | |
| CN | 205527118 | U | 8/2016 | |
| CN | 104229577 | B | 12/2016 | |
| EP | 2336070 | A1 | 6/2011 | |
| EP | 2840052 | A1 | 2/2015 | |
| JP | H047282 | A | 1/1992 | |
| JP | 2000272856 | A | 10/2000 | |
| JP | 2000344436 | A | 12/2000 | |
| JP | 2012188199 | A * | 10/2012 | B66B 5/00 |
| JP | 2012188199 | A | 10/2012 | |
| KR | 1020160044427 | A | 4/2016 | |
| WO | 2014006764 | A1 | 1/2014 | |
| WO | 2014006765 | A1 | 1/2014 | |
| WO | 2014006766 | A1 | 1/2014 | |
| WO | 2014184884 | A1 | 11/2014 | |
| WO | 2014184885 | A1 | 11/2014 | |
| WO | 2014184886 | A1 | 11/2014 | |
| WO | 2015004790 | A1 | 1/2015 | |
| WO | 2015004791 | A1 | 1/2015 | |
| WO | 2015004793 | A1 | 1/2015 | |
| WO | 2016091309 | A1 | 6/2016 | |
| WO | 2016097241 | A1 | 6/2016 | |

OTHER PUBLICATIONS

Otis (REM Remote Elevator Monitoring), Available at: http://www.otis.com/site/gb/pages/RemoteElevatorMonitoring.aspx, Accessed on Oct. 31, 2017 (2pp).

Schindler Remote Monitoring™ (A proactive approach to problem solving), Available at https://www.schindler.com/content/us/internet/en/modernization/high-rise-elevator-modernization/_jcr_content/rightPar/downloadlist/downloadList/198_1338926711062.download.asset.198_1338926711062/SCHIN097_RemoteMonitoringBrochureRevise.pdf, Accessed Oct. 31, 2017 (4 pp).

European Office Action for Application No. 16 290 209.2-1017; dated Jun. 4, 2018; 4 pgs.

Chinese Office Action for application CN 201711038430.2, dated Dec. 17, 2019, 16 pages.

* cited by examiner

AUTOMATIC TEST OF DETERRENT DEVICE

CROSS-REFERENCE TO RELATED APPLICATIONS

This counterpart application claims the benefit of European Application No. 16290209.2 filed Oct. 31, 2016, which is incorporated herein by reference in its entirety.

BACKGROUND

The subject matter disclosed herein generally relates to elevator car operations and maintenance and, more particularly, to methods and apparatus for conducting automatic testing of an elevator car door interlock and deterrent device.

In a typical elevator or lift installation, the vertically moving elevator car is positioned so as to align its entrance with corresponding openings at a plurality of landings in a multi-floor building. Modern installations typically have one or more horizontally sliding doors disposed on the elevator car and at least one sliding door disposed on each of the landing floors, all of which remain closed during movement of the elevator car within a hoistway.

Upon arrival of the elevator car at a floor or landing, a door opening mechanism is activated which drives the elevator car door horizontally for permitting access to the elevator car. In typical installations, a door coupler employing one or more vanes projecting from the surface of the elevator car door in the direction of the adjacent landing door engages various structures, for example vanes, rollers, or other protrusions projecting from the landing door, to drive the landing door horizontally, thereby permitting passengers to traverse between the car and landing.

Elevator codes and regulations require that the elevator landing door remain fastened securely and not open beyond a specified tolerance against unauthorized entry unless an elevator car is positioned directly adjacent the landing. Likewise, in certain countries, the elevator car door must remain latched against manual movement unless the elevator car is positioned so as to register with a landing. Various mechanisms and systems have been employed to secure and unsecure landing and elevator car doors as the elevator car traverses the elevator hoistway. Existing interlock systems are typically actuated by solenoids or are mechanically linked to the door coupler. These interlock systems require inspection and have regular service requirements. There is a desire to automate and reduce or eliminate scheduled inspections and maintenance. As such, solutions to eliminate risks for technicians and save inspection and maintenance times would be desirable.

SUMMARY

According to an embodiment, disclosed herein is a method of testing an elevator car door interlock and deterrent mechanism in an elevator system, with an elevator car operating in a hoistway, having an elevator car door, and a plurality of landings each with a landing door. The method includes ensuring that no passengers are in the elevator car and operating the elevator and stopping the elevator car when it is not at any landing, commanding the elevator car door to open for a predetermined duration and measuring a displacement of the elevator car door from a closed position, and finally, closing the elevator car door and operating the elevator car to return to a landing of the plurality of landings.

Also disclosed herein is a system for testing an elevator car door interlock and deterrent mechanism in an elevator system. The system for testing an elevator car door interlock and deterrent mechanism includes an elevator car with an elevator car door operable in a hoistway with a plurality of landings, each landing having a landing door, and an elevator car door interlock and deterrent mechanism configured to interlock the elevator car door and the landing door and to ensure that the elevator car door is only operable to open when the elevator car is at a landing. The system for testing an elevator car door interlock and deterrent mechanism also includes a controller in operable communication with the elevator car and the elevator car door interlock and deterrent mechanism, the controller being operable to perform the method of testing the elevator car door interlock and deterrent mechanism described above.

In addition to one or more of the features described above, or as an alternative, further embodiments may optionally include operating the elevator car to move it to a selected landing of the plurality of landings and opening the elevator car door and landing door corresponding to the selected landing; and upon completion of the ensuring, closing the elevator car door and landing door at the selected landing.

In addition to one or more of the features described above, or as an alternative, further embodiments may include returning the elevator car to service if the testing is successful, otherwise initiating maintenance.

In addition to one or more of the features described above, or as an alternative, further embodiments may include that the elevator car door interlock and deterrent mechanism includes an interlock operable when the elevator car door and a landing door are aligned.

In addition to one or more of the features described above, or as an alternative, further embodiments may include a presence detector configured to ascertain a presence of a passenger in the elevator car, or further yet that the presence detector includes at least one of: a proximity sensor, PIR sensor, motion detector, touch sensitive sensor, load weight sensor, radar detector, optical sensor, and a camera. In addition, the presence detector may be a floor mat operable to detect that a passenger is standing in the elevator car. Moreover, the presence detector is operable to limit detection to a single passenger.

In addition to one or more of the features described above, or as an alternative, further embodiments may include generating a report based on results of the measuring of the displacement of the elevator car door and further yet, transmitting the report to an interested party.

In addition to one or more of the features described above, or as an alternative, further embodiments may include that the interested party includes at least one of service personnel, building owners and operators, elevator manufacturers, and regulatory authorities.

In addition to one or more of the features described above, or as an alternative, further embodiments may include that the testing is initiated remotely.

In addition to one or more of the features described above, or as an alternative, further embodiments may include that the testing is successful if the displacement of the elevator car door is less than a predetermined threshold and further still that the predetermined threshold is less than or equal to about 100 millimeters. In another embodiment the predetermined threshold is less than or equal to about 50 millimeters, and in yet another embodiment, the predetermined threshold is less than or equal to about 40 millimeters.

Technical effects of embodiments of the present disclosure include a system and methodology for testing an elevator car door interlock and deterrent mechanism in an elevator system.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

The following description is merely illustrative in nature and is not intended to limit the present disclosure, its application or uses. As used herein, the term controller refers to processing circuitry that may include an application specific integrated circuit (ASIC), an electronic circuit, an electronic processor (shared, dedicated, or group) and memory that executes one or more software or firmware programs, a combinational logic circuit, and/or other suitable interfaces and components that provide the described functionality.

Additionally, the term "exemplary" is used herein to mean "serving as an example, instance or illustration". Any embodiment or design described herein as "exemplary" is not necessarily to be construed as preferred or advantageous over other embodiments or designs. The terms "a", "at least one" and "one or more" are understood to include any integer number greater than or equal to one, i.e. one, two, three, four, etc. The terms "a plurality" are understood to include any integer number greater than or equal to two, i.e., two, three, four, five, etc. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. The term "connection" can include an indirect connection and a direct connection.

Figure 1:
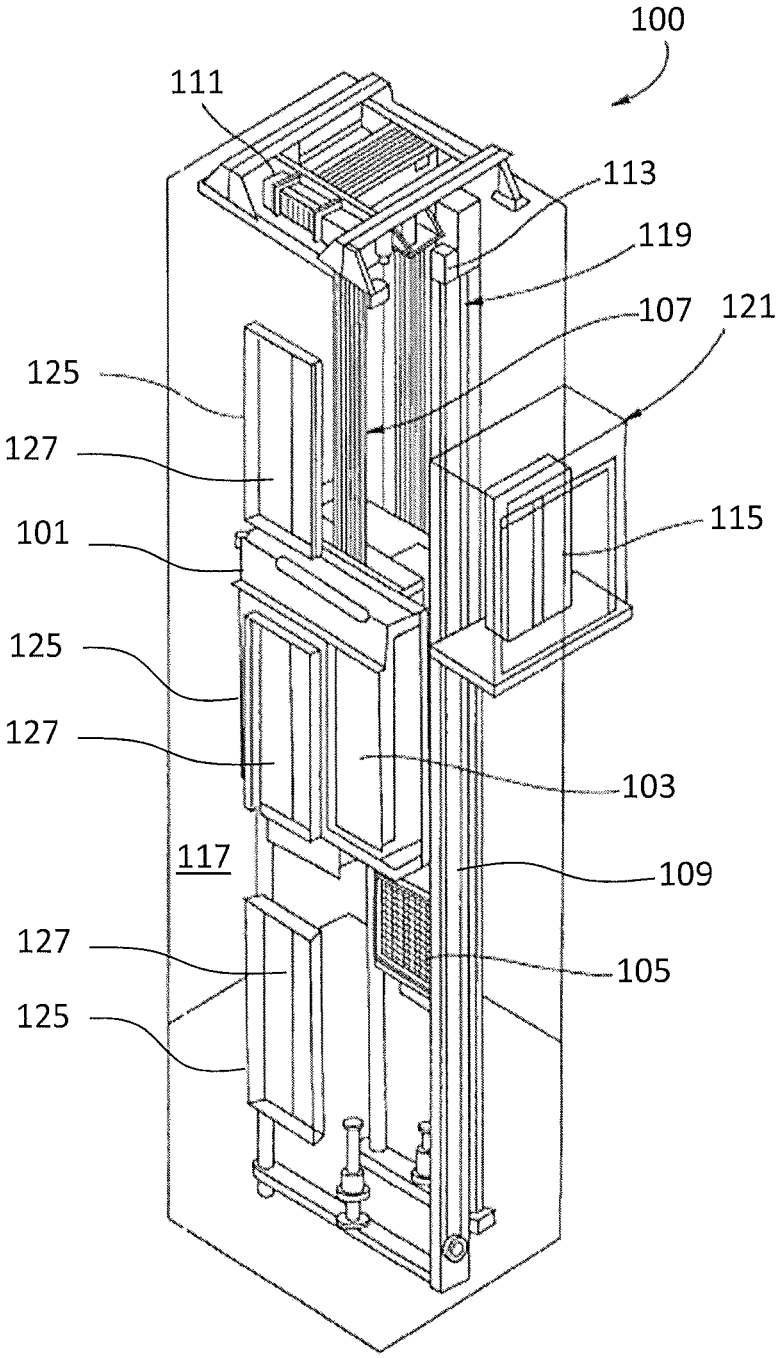
FIG. 1 is a schematic illustration of an elevator system that may employ various embodiments of the present disclosure.

FIG. 1 is a perspective view of an elevator system 100 including an elevator car 103, a counterweight 105, roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109. Although shown and described with roping 107, elevator systems 100 that employ other methods and mechanisms of moving an elevator car 103 within an elevator shaft 117 may employ embodiments of the present disclosure. FIG. 1 is merely a non-limiting example presented for illustrative and explanatory purposes.

The roping 107 engages the machine 111, which is part of an overhead structure of the elevator system 100. The machine 111 is configured to control movement between the elevator car 103 and the counterweight 105. The machine 111 may include a motor or similar driving mechanism. In accordance with embodiments of the disclosure, the machine 111 is configured to include an electrically driven motor. The power supply for the motor may be any power source, including a power grid, generator, batteries and the like. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

In general, the controller 115 may receive one or more input signals/information corresponding to various components of the elevator system 100 to facilitate elevator system operations, diagnostics, maintenance, and the like. The input signals/information may include, but are not limited to, a position signal from the position encoder 113, car load weight, brake status, car door status, door switch signal(s), car input power, car calling status, service operation mode status, door position, car emergency status, input power status, and the like. Based on the information, the controller 115 determines the status of, and provides commands to, the elevator system 100 including one or more elevator cars 103. For example, the controller 115 may provide drive signals to the machine 111 to control the acceleration, deceleration, leveling, stopping, etc. of the elevator car 103. In addition, the controller 115 may control the elevator car door (not shown), annunciators, and the like. In the figure, the controller 115 is located, as shown, in a controller room 121 of the elevator shaft 117. It should be appreciated that while a particular placement for the controller 115 and other components of the elevator system 100 is shown, this is for example only to facilitate illustration and is in no way limiting. Likewise, while a single controller 115 is disclosed for the purposes of illustration, a modular or distributed configuration could also be employed with various functions allocated as need be.

The controller 115 may also receive signals from other on board sensors such as a presence detector 101 to facilitate determining if any passengers are in the elevator car 103. In one embodiment the presence detector 101 may include, but not be limited to, a standard proximity sensor, passive infrared (PIR) sensor, motion detector, radar sensor, optical sensor, an image/video camera, and the like. Other presence detectors 101 might include touch sensitive sensors placed in the vicinity of a user interface, for example, touch sensitive detectors in the elevator car 103, or even a floor mat that detects whether a passenger is standing in the elevator car 103. The presence detector 101 may be installed at a variety of locations as may suit the application and environment. Certain presence detectors 101 may be installed so that their range and field of view are such that it limits false detections. Further still, selected presence detectors 101 may be installed to limit detection to a single passenger. For example, the presence detector 101 may be installed as a proximity detector above, below, or directed radially outwardly from a corner in the elevator car 103.

Figure 2:
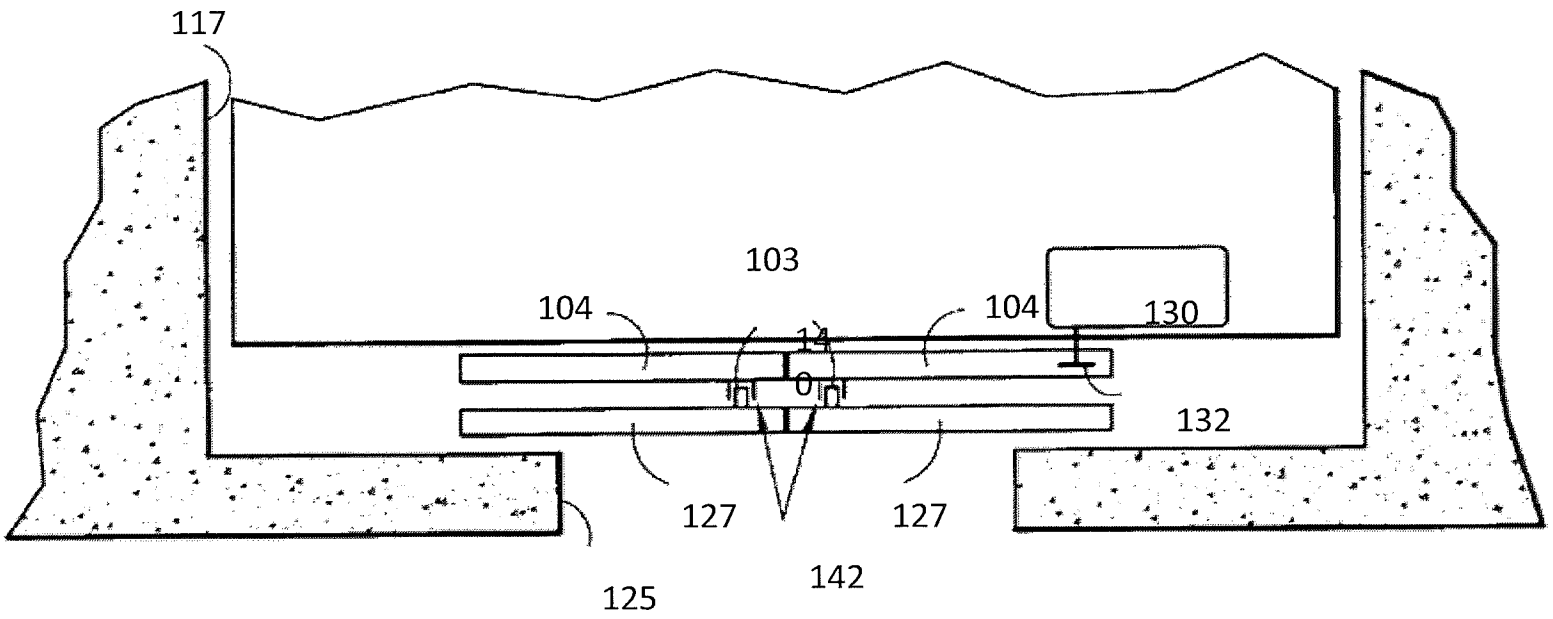
FIG. 2 is a partial plan view of an elevator car in a hoistway where the elevator car door and the landing door are in a closed position.
Figure 3:
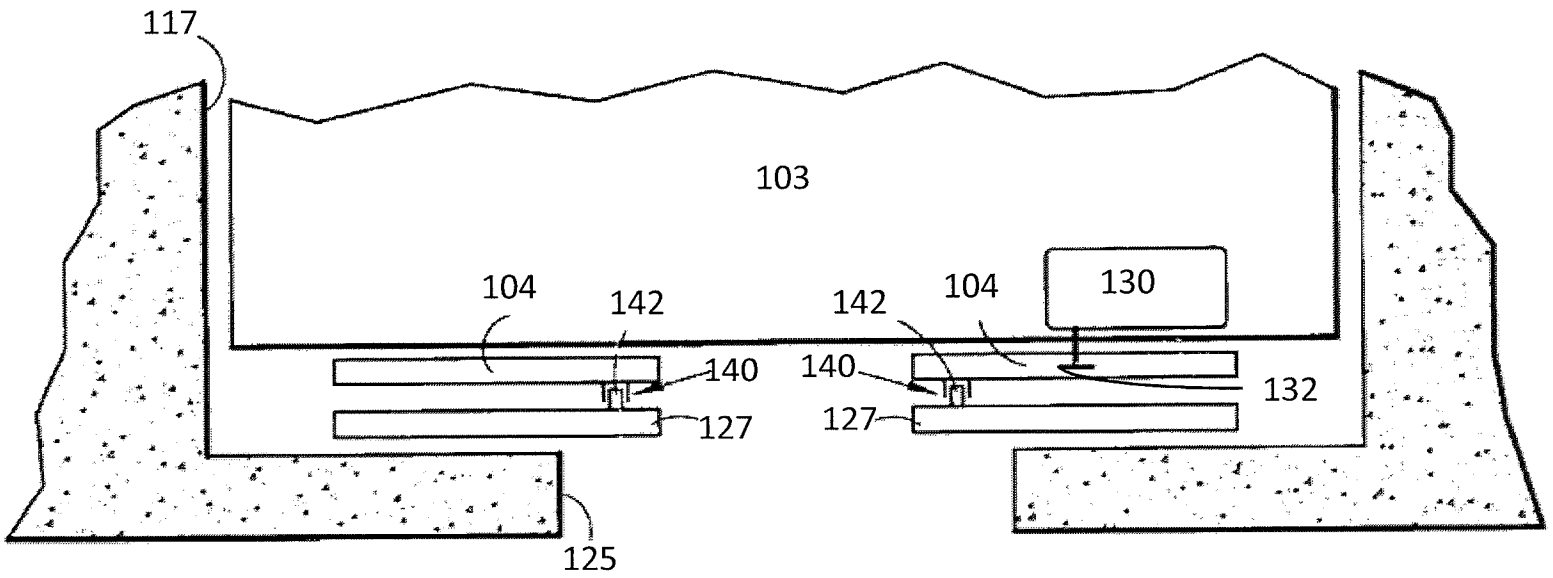
FIG. 3 is a partial plan view of an elevator car in a hoistway where the elevator car door and the landing door are in a partially opened position.

Turning to FIGS. 2 and 3, FIG. 2 shows a partial plan view of an elevator car 103 disposed in a vertical hoistway 117 and positioned so as to correspond to a landing 125 having an opening. Elevator car door(s) 104 (two are shown in this instance) are shown in correspondence with laterally sliding landing door(s) 127 (again, two are shown in this instance). As is typical in such installations, the elevator car door 104 is actuated by a door operator 130, in operable communication with controller 115, shown disposed atop the elevator car 103 and having a drive belt or other drive mechanism 132. FIG. 2 depicts the elevator car door 104 and landing door 127 in a closed position. FIG. 3 shows the arrangement of FIG. 2 where the elevator car door 104 and the landing door 127 are in a partially opened position.

In one configuration of an elevator system, a door coupler 140 disposed on the elevator car door 104 is shown engaged with a corresponding protrusion 142 which extends inwardly from the landing door 127. The protrusions 142 may be any sort of raised boss, bumper, rod, or roller, configured to provide a simple and effective means for enabling the door coupler 140 to engage and move the landing door 127 upon and concurrently with operation of the elevator car door 104. As will be appreciated by those skilled in the art, it is desirable that the door coupler 140 firmly/tightly grip the landing door protrusion 142 when the elevator car door and landing door 127 are operated. In addition, it is also desirable that the door coupler 140 completely release said protrusions 142 and maintain sufficient running clearance as the elevator car 103 moves vertically through the hoistway 117. The door coupler 140 is configured to operate only once it has been determined that the elevator car 103 is positioned within a landing door zone, adjacent at least one landing door 127.

Figure 4:
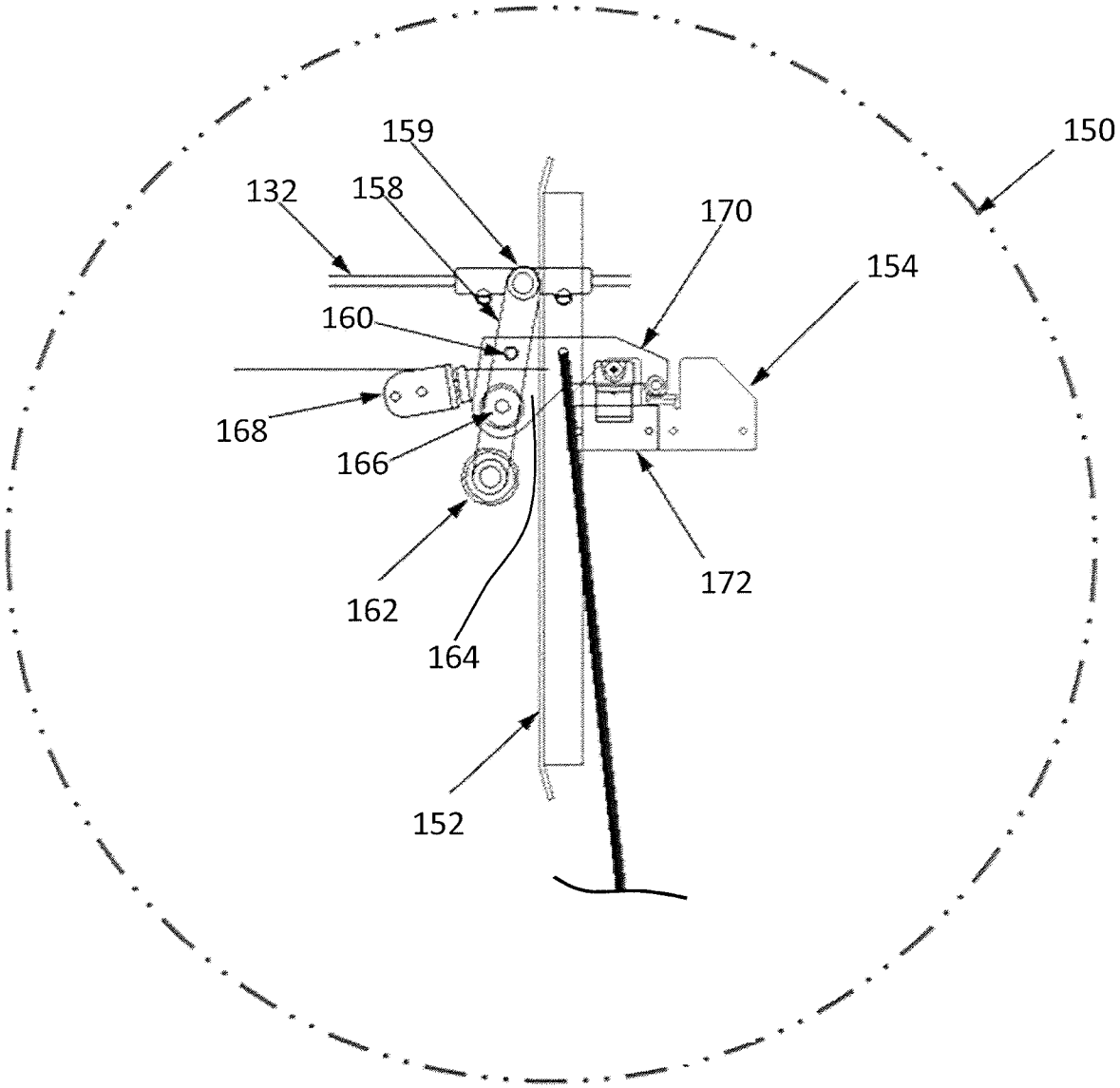
FIG. 4 is a partial view of an elevator car door interlock and deterrent mechanism as employed with an embodiment of the present disclosure.
Figure 5:
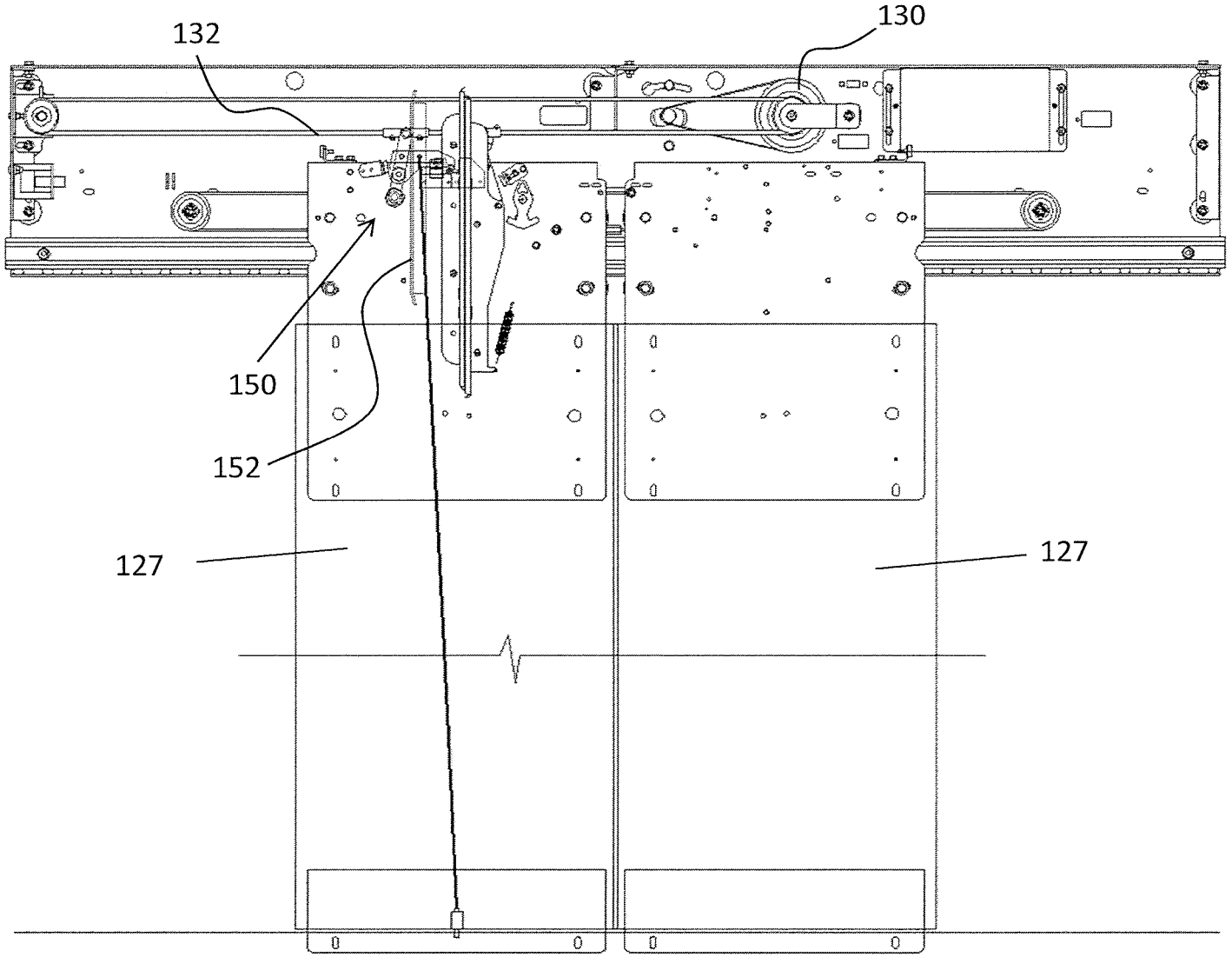
FIG. 5 is a depiction of an elevator car door interlock and deterrent mechanism shown with an elevator car door and a door operator in accordance with an embodiment of the present disclosure.

Turning now to FIGS. 4 and 5 as well, an example of an elevator car door interlock and deterrent device 150 is depicted for illustration purposes. In all elevator systems, an elevator car door interlock and deterrent device 150 is used to permit opening of the elevator car door 104 and the landing door 127 only when the elevator car 103 is appropriately positioned within a landing door zone at a landing 125. Moreover, the elevator car door interlock and deterrent device 150 ensures that the elevator car door 104 or landing door 127 cannot be opened when the elevator car 103 is not at the respective landing 125. It should be appreciated that the operation of the elevator car door interlock and deterrent device 150 as described herein while relevant to the present disclosure is for example only and not in any way to be considered as limiting the breadth and scope of the claims.

The elevator car door interlock and deterrent device 150 includes a lock member 154 mounted to a ground component, such as the car door header or hanger for example. The lock member 154 is configured to lock an upper portion of the elevator car door 104. A link arm 158 is coupled such as at a first end 159 for example, to the drive mechanism 132 of the door operator 130. As the door operator 130 moves the drive mechanism 132, the drive mechanism 132 is configured to rotate the link arm 158 about a first pin 160. A sensing roller 162 is coupled to a portion of the link arm 158, for example the second end thereof. In addition, an engagement latch 164 is pivotally connected to the link arm 158 at a second pin 166. A bumper 168 is positioned generally adjacent the link arm 158 and a portion of the engagement latch 164. The bumper 168 is configured to limit rotation of the engagement latch 164 about the second pin 166. When the elevator car door 104 is in a closed position, the engagement latch 164 is arranged in contact with an electrical switch 172 of the lock member 154. This electrical switch 172 sends a signal to the controller 115 of the elevator system 100 confirming that the elevator car door 104 is closed.

As the elevator car 103 enters a landing zone in proximity to a landing 125, the door operator 130 actuates the drive mechanism 132. As the drive mechanism moves (to the left in the figure) the link arm 158 pivots around the first pin 160. This movement of the link arm 158 causes the sensing roller 162 disposed near an end of the link arm 158 to rotate into contact with a sensing vane 152. Upon contact with the sensing vane 152, further operation of the drive mechanism 132 causes the engagement latch 164 to pivot about the second pin 166 until the engagement latch 164 contacts the bumper 168. Rotation of the engagement latch 164 separates the engagement hook 170 from the electrical switch 172, thereby generating a signal that the elevator car door 104 is unlocked. In this position, the elevator car door 104 and landing door 127 are coupled by the door coupler 140 (FIG. 2) and are able to translate to a fully open position.

To close the elevator car door 104, the door operator 130 actuates the drive mechanism 132 in the opposite direction, causing the link arm 158 to pivot about the first pin 160 and the engagement latch 164 to rotate about the second pin 166 such that the engagement hook 170 rotates into contact with the electrical switch 172. The link arm 158 further rotates to move the roller 162 away from the sensing vane 152. In this position, the elevator car 103 is free to move throughout the hoistway 117 without interference.

It should be noted that if the door operator 130 actuates the drive mechanism 132 when the elevator car 103 is not within a landing zone in proximity to a landing 125, the elevator car door 104 will not open. When the elevator car door 104 and landing door are not aligned and therefore the sensing vane 152 is absent, operation of the door operator 130 causes the link arm 158 to rotate freely about the first pin 160. Notably, without the contact between the sensing roller 162 and the sensing vane 152, the link arm 158 now rotates relative to the engagement latch 164 and the engagement latch 164 does not rotate about the second pin 166. As a result, the engagement hook 170 remains engaged with lock 154 and in contact with the electrical switch 172 and the elevator car door 104 remains locked. The elevator car door interlock and deterrent device 150 illustrated and described herein is intended as an example only and other door interlocks and door controls are within the scope of the disclosure. In addition, the elevator car door interlock and deterrent device 150 or door operator 130 may further include a position sensor (not shown) configured to detect the position of the elevator car door 104. In an embodiment, the door operator 130 includes an encoder as a positon sensor employed to measure the displacement of the elevator car door 104. The encoder increments are readily counted using conventional techniques between a first position for the elevator car door 104 and a second position of the elevator car door 104 to determine a displacement. For example, as will be discussed further at a later point herein, the total encoder increment count from an elevator car door closed position to an elevator car door 104 stopped position is readily correlated to a displacement of the partially opened elevator car door 104 (once stopped by deterrent device).

It may be desired or even required to perform maintenance on aspects of the elevator system 100, e.g., maintenance to verify the operation of the elevator car and landing door 104, 127 and more specifically the elevator car door interlock and deterrent device 150. In fact, code requirements may also dictate testing not only the operation of the elevator car door interlock and deterrent device 150 but also its operation within specifications. Required testing and reporting consumes maintenance hours and requires a mechanic on site to execute tests and generate reports. Moreover, it may be advantageous to report on the results of such testing to a system operator, building manager, the manufacturer, even regulatory personnel if needed, and the like.

Figure 6:
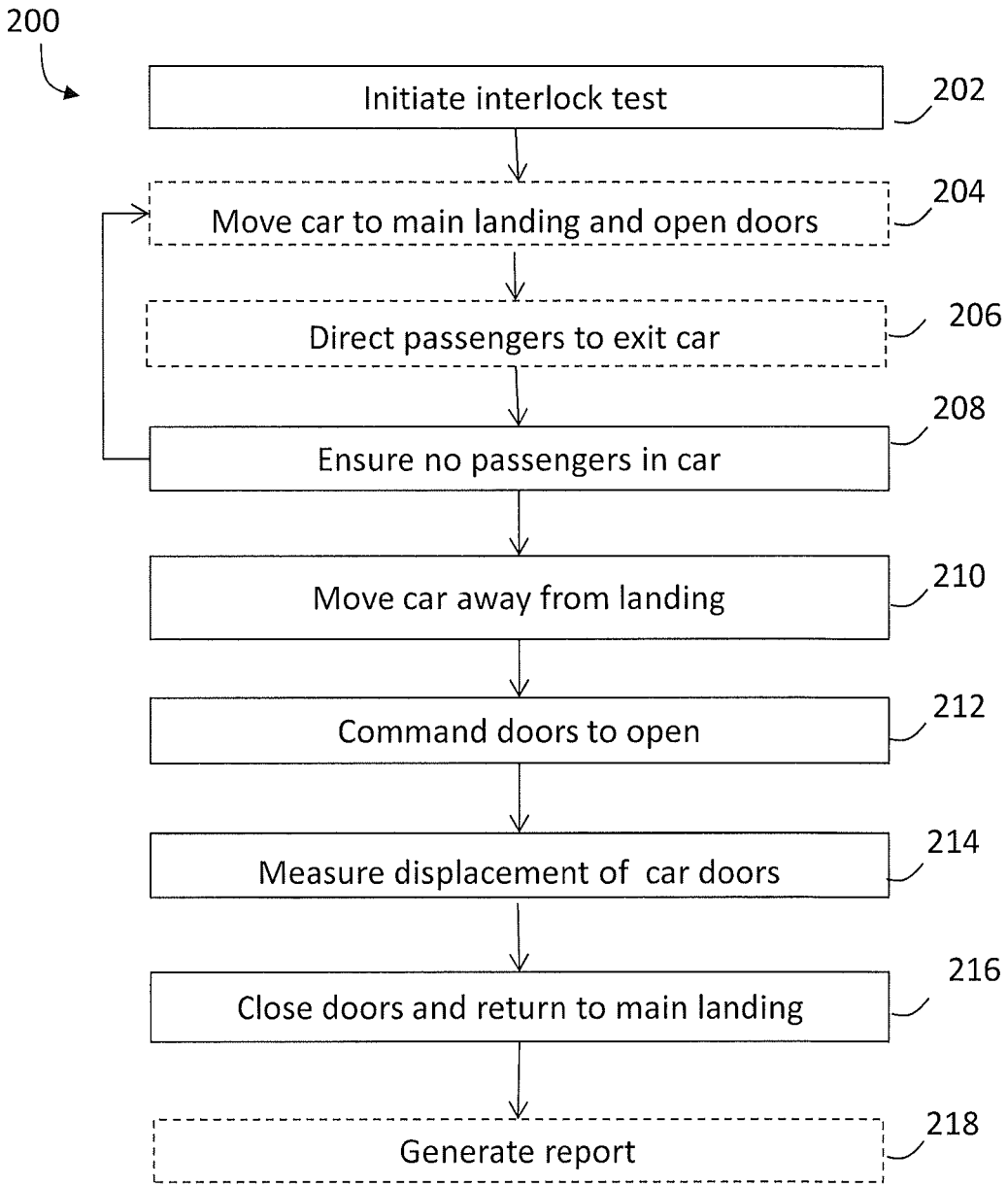
FIG. 6 is a flow process for testing an elevator car door interlock and deterrent mechanism in accordance with an embodiment of the present disclosure.

Turning now to FIG. 6, a method 200 of automatically testing the function and operation of the elevator car door interlock and deterrent device 150 is depicted. The method 200 may be performed by controller 115 or another controller interfacing with controller 115 to affect the control of the elevator system 100 including the elevator car 103, elevator car door 104, and the like, as required. In an exemplary embodiment, at process step 202 the elevator car door interlock and deterrent test is initiated. The test can be initiated automatically and remotely via a maintenance and diagnostics system, or the test could be initiated by a mechanic or repairman on site. For example, in one embodiment the test may be initiated by a mechanic with an input at a maintenance panel in the elevator system 100. Conducting the test with passengers in the car could be alarming as they would not know what the elevator car 103 is doing. Therefore, in an embodiment, at process step 204, optionally, the elevator car 103 is moved to a selected landing, e.g., the "main" landing 125, and the elevator car door 104 and landing door 127 are opened. Passengers may then be notified and directed to exit the elevator car 103 as depicted at process step 206. The notification can be automated, displayed on the car operating panel inside the elevator car 103 or manually by an operator or mechanic. As depicted at process step 208, the method continues with ensuring that there are no passengers in the elevator car 103. In an embodiment, the controller 115 determines that there are no passengers in the elevator car 103 based on the car load weight. In another embodiment, the controller may use the information from a presence detector 101 for the verification. For example, in one instance, information from a motion detector or camera may be employed to ensure that there are no passengers in the elevator car 103. If there are no passengers in the elevator car 103, the elevator car doors are closed and the test continues. Otherwise, process steps 204, 206 (optionally), and then 208 are repeated until there are no passengers in the elevator car 103. Advantageously, the testing need not interrupt normal elevator system 100 operation. The method 200 can be conducted anytime as required. For example, the test could be conducted automatically during idle time when there is no demand for service, such as overnight, or midday.

Continuing with FIG. 6 and turning now to process step 210 the elevator car door 104 and landing door 127 are then closed and the elevator car 103 is moved away from the main landing 125 and stopped between any two landings 125 in the hoistway 117. The controller 115 then commands opening the elevator car door 104 and landing door 127 as depicted at process step 212. As described earlier, at this position the elevator car door 104 and landing door 127 should not open as the elevator car door interlock and deterrent device 150 engages and prohibits the opening of the elevator car door 104 and landing door 127. In an embodiment the elevator car door 104 and landing door 127 are commanded to open for a selected period of time. At process step 214 the displacement of the elevator car door 104 and landing car door 127 is determined. It should be appreciated that while no specific duration for commanding the elevator car door 104 and landing door 127 to open is identified, it should at least be long enough to ensure that an accurate measurement of the displacement of the elevator car door 104 and landing door 127 is obtained. Finally at process step 216 the measurement and testing is completed, the elevator car door 104 and landing door 127 are commanded to be closed by the controller, and once closed, the elevator car 103 is returned to service if the testing was successful, and directed to a landing 125.

In an embodiment, if the testing turns out not to be successful, the elevator system 100 may be removed from service and/or maintenance may be initiated. If maintenance personnel are on site conducting the testing, then the maintenance may be performed at this time to adjust the operation of the elevator car door interlock and deterrent device 150. In an embodiment the testing is successful if the elevator car door opens less than a predetermined distance. In an embodiment, the predetermined distance is less than or equal to about 100 millimeters, in another embodiment the predetermined distance is less than or equal to about 50 millimeters, in yet another embodiment the predetermined distance is less than or equal to about 40 millimeters. Optionally, the method 200 may further include generating a report based on the results of the measuring of the displacement of the elevator car door 104 and to transmit this report to various parties. For example, a report could be generated showing that the test has been conducted at required intervals to satisfy code requirements, or that the test was actually completed and not mistakenly forgotten. Furthermore, the report may readily be provided, whether automatically or not, to a variety of interested parties, including but not limited to service personnel, building owners and operators, elevator manufacturers, and ultimately even regulatory authorities.

As will be appreciated by those of skill in the art, although flow process 200 provides a particular order of steps, this is not intended to be limiting. For example, various steps may be performed in a different order and/or various steps may be performed simultaneously or omitted. For example, blocks 212-214 may occur substantially simultaneously such that the movement of the doors and measurement happen at substantially the same time or in one motion or operation, without departing from the scope of the present disclosure.

Advantageously, embodiments described herein provide an easy automated test of the elevator car door interlock and deterrent device and may allow for simplified or automated maintenance operations from inside the elevator car or remotely (i.e., there may be no need for an operator or technician to enter an elevator shaft) because the technician may access exterior components from inside the elevator car.

Moreover, advantageously, because the testing employs existing components no additional cost or complexity is added to the elevator system to conduct or automate the test.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

For example, although shown with various structures and configurations for the elevator car door interlock and deterrent mechanism, those of skill in the art will appreciate that other geometries, configurations, means of movement, etc. may be used without departing from the scope of the present disclosure.

Accordingly, the present disclosure is not to be seen as limited by the foregoing description, but is only limited by the scope of the appended claims.

What is claimed is:

1. A method of testing an elevator car door interlock and deterrent mechanism in an elevator system, with an elevator car operating in a hoistway having elevator car door and a plurality of landings each with a landing door, the method comprising:

ensuring that no passengers are in the elevator car;

operating the elevator car to stop the elevator car when it is not at any landing of the plurality of landings;

commanding the elevator car door to open for a predetermined duration and measuring a displacement of the elevator car door from a closed position; and closing the elevator car door and operating the elevator car to return to a landing of the plurality of landings.

2. The method of claim 1, further comprising generating a report based on results of the measuring of the displacement of the elevator car door.

3. The method of claim 2, further comprising transmitting the report to an interested party.

4. The method of claim 3, wherein the interested party includes at least one of service personnel, building owners and operators, elevator manufacturers, and regulatory authorities.

5. The method of claim 1 wherein the testing is initiated remotely.

6. The method of claim 1 wherein the testing is successful if the displacement of the elevator car door is less than a predetermined threshold.

7. The method of claim 6 wherein the predetermined threshold is less than or equal to about 100 millimeters, more particularly, less than or equal to about 50 millimeters, even more particularly less than or equal to about 40 millimeters.

8. The method of claim 1 further comprising:

operating the elevator car to move it to a selected landing of the plurality of landings and opening the elevator car door and landing door corresponding to the selected landing; and upon completion of the ensuring, closing the elevator car door and landing door at the selected landing.

9. The method of claim 1 further comprising:

returning the elevator car to service if the testing is successful, otherwise initiating maintenance.

10. A system for testing an elevator car door interlock and deterrent mechanism in an elevator system, the system comprising:

an elevator car with an elevator car door operable in a hoistway with a plurality of landings, each landing having a landing door;

an elevator car door interlock and deterrent mechanism configured to interlock the elevator car door and the landing door and operable to ensure that the elevator car door is only operable to open when the elevator car is at a landing of the plurality of landings; and a controller in operable communication with the elevator car and the elevator car door interlock and deterrent mechanism, the controller operable to perform the method of testing an elevator car door interlock and deterrent mechanism comprising:

ensuring that no passengers are in the elevator car;

operating the elevator car to stop the elevator car when it is not at any landing of the plurality of landings;

commanding the elevator car door to open for a predetermined duration and measuring a displacement of the elevator car door from a closed position; and closing the elevator car door and operating the elevator car to return to a landing of the plurality of landings.

11. The system of claim 10, wherein the elevator car door interlock and deterrent mechanism includes an interlock operable when the elevator car door and a landing door are aligned.

12. The system of claim 10, further comprising a presence detector configured to ascertain a presence of a passenger in the elevator car.

13. The system of claim 12, wherein the presence detector includes at least one of a floor mat, proximity sensor, PIR sensor, motion detector, touch sensitive sensor, load weight sensor, radar detector, optical sensor, and a camera.

14. The system of claim 13, wherein the presence detector is operable to limit detection to a single passenger.

* * * * *